US007532829B2

(12) United States Patent
Okada

(10) Patent No.: US 7,532,829 B2
(45) Date of Patent: May 12, 2009

(54) IMAGE FORMING APPARATUS HAVING ADJUSTABLE COMMUNICATION WITH TONER CONTAINER

(75) Inventor: Masanori Okada, Osaka (JP)

(73) Assignee: Kyocera Mita Corporation (JP)

( * ) Notice: Subject to any disclaimer, the term of this patent is extended or adjusted under 35 U.S.C. 154(b) by 118 days.

(21) Appl. No.: 11/701,619

(22) Filed: Feb. 2, 2007

(65) Prior Publication Data

US 2007/0183794 A1 Aug. 9, 2007

(30) Foreign Application Priority Data

Feb. 9, 2006 (JP) ..... 2006-031829

(51) Int. Cl.
*G03G 15/08* (2006.01)
*G03G 15/00* (2006.01)

(52) U.S. Cl. ..... 399/27; 399/12

(58) Field of Classification Search ..... 399/12, 399/27, 119, 262
See application file for complete search history.

(56) References Cited

U.S. PATENT DOCUMENTS 6,807,380 B2 * 10/2004 Iida et al. ..... 399/12
6,985,119 B2 * 1/2006 Forster et al. ..... 343/767
2006/0094458 A1 * 5/2006 Kitaji ..... 455/522

FOREIGN PATENT DOCUMENTS

JP 2005-78100 3/2005

* cited by examiner

*Primary Examiner*—Sandra L Brase
(74) *Attorney, Agent, or Firm*—Gerlad E. Hespos; Anthony J. Casello

(57) ABSTRACT

An image forming apparatus includes: a main body; a toner container detachably mounted to the main body; a wireless tag provided on the toner container; and a communicator provided in the main body and being capable of performing a wireless communication with the wireless tag, wherein the communicator includes: a communication strength detector for detecting a communication strength of the wireless communication performed with the wireless tag; and a communication output adjuster for changing the communication output of the communicator so that the communication strength detector detects a predetermined communication strength, when a communication strength detected by the communication strength detector is not the predetermined communication strength.

4 Claims, 10 Drawing Sheets

IMAGE FORMING APPARATUS HAVING ADJUSTABLE COMMUNICATION WITH TONER CONTAINER

BACKGROUND OF THE INVENTION

1. Field of the Invention

The present invention relates to an image forming apparatus to which a toner container provided with a wireless tag thereon is detachably mounted.

2. Description of the Related Art

Conventionally, image forming apparatuses such as a laser beam printer, a digital copier and a laser facsimile adopting an electrophotographic method have been used. In these image forming apparatuses, an image developing device develops an electrostatic latent image formed on a photoconductive drum by toner particles supplied from a toner cartridge. In the toner cartridge for supplying toner particles to the image developing device, there is provided a wireless tag (wireless IC tag) for storing information such as kinds and characteristics of the contained toner particles and the number of use of the toner cartridge. A communication unit provided in a main body of the image forming apparatus performs a wireless communication with the wireless tag so that information such as kinds and characteristics of toner particles and the number of use of the toner cartridge is transmitted to a controller of the main body (refer to Japanese Unexamined Patent Publication No. 2005-78100).

However, a distance within which the communication unit provided in the main body can perform the wireless communication with the wireless tag (hereinafter simply referred to as "communication distance") is changed due to factors such as kinds and amount of toner particles in the toner cartridge or variation of used components. For example, when kinds and amount of toner particles are changed, metals (magnetic bodies) included in toner particles exert influence on a resonant frequency in a resonant circuit or the like in the wireless tag and thereby changes the communication distance (changes the strength of the wireless communication). Therefore, even when kinds and amount of toner particles are changed according to a passage of used time, it has been necessary to maintain a communication output at a level where the communication unit and the wireless tag are communicable. Therefore, there has been raised a problem that the communication output becomes excessively great according to conditions such as kinds and amount of toner particles and thereby causes a high level of unwanted radiation to be occurred.

SUMMARY OF THE INVENTION

The present invention was made in view of the problems described above. An object of the invention is to suppress occurrence of unwanted irradiation in a communication taken place in an image forming apparatus between a wireless tag of a toner container and a main body of an image forming apparatus.

More specifically, an image forming apparatus of the present invention includes: a toner container detachably mounted to a main body; a wireless tag provided on the toner container; and a communicator provided in the main body and being capable of performing a wireless communication with the wireless tag, wherein the communicator includes: a communication strength detector for detecting a communication strength of the wireless communication performed with the wireless tag; and a communication output adjuster for changing the communication output of the communicator so that the communication strength detector detects a predetermined communication strength, when a communication strength detected by the communication strength detector is not the predetermined communication strength.

According to the present invention, when a communication strength detected by the communication strength detector is not the predetermined communication strength, the communication output of the communicator is adjusted by the communication output adjuster so that the communication strength of the communicator becomes a predetermined communication strength. Accordingly, even when a communication distance between the communicator and the wireless tag is changed due to factors such as kinds and amount of toner particles contained in the toner container, the communication output of the communicator is adjusted by the communication output level adjuster correspondingly to changes in conditions so as to be at a communication output in the communication strength. Therefore, even without setting the communication output of the communicator at an excessively high level, the communication output level of the communicator can be maintained in a state where a communication with the wireless tag is possible regardless of changes in conditions. Thus, unwanted irradiation generated from a communication output of the communicator can be suppressed to a low level.

These and other objects, features and advantages of the present invention will become more apparent upon reading of the following detailed description along with the accompanied drawings.

DETAILED DESCRIPTION OF THE PREFERRED EMBODIMENTS

Figure 1:
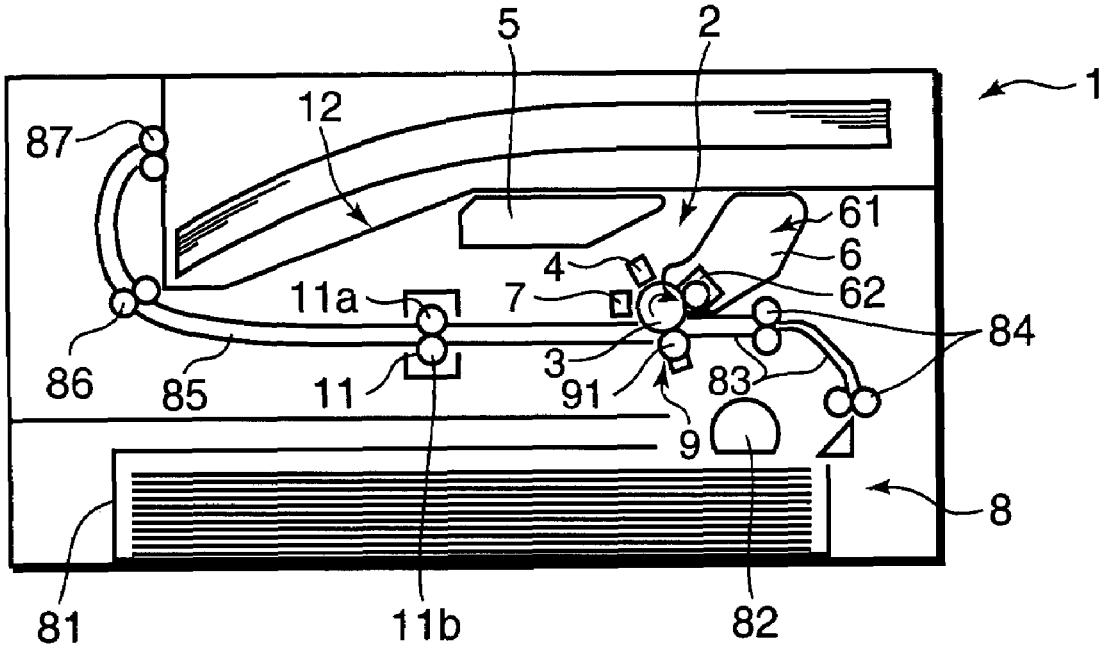
FIG. 1 is a sectional view schematically showing an internal configuration of a printer embodying an image forming apparatus according to the present invention.

Hereinafter, an image forming apparatus according to the present invention is described with reference to the drawings. FIG. 1 is a sectional view schematically showing an internal configuration of a printer 1 embodying the image forming apparatus according to the present invention.

The printer 1 includes a sheet feeding section 8, an image forming section 2, a transferring section 9, a fixing section 11, a sheet discharging tray 12 and the like.

The image forming section 2 is provided with a photoconductive drum 3, a charging portion 4, a disposing portion 5, a developing portion 6, a cleaning portion 7 and the like.

The photoconductive drum 3 is an image bearing member on which a toner image is formed. The charging portion 4 uniformly charges electricity on the photoconductive drum 3. The exposing portion 5 exposes a peripheral surface of the photoconductive drum which is uniformly charged with electricity to thereby cause an electrostatic latent image to be formed. The developing portion 6 develops the electrostatic latent image to thereby form a toner image. The toner image formed in such a manner is transferred onto a recording sheet by a transferring section 9 described in details hereinafter. The cleaning portion 7 cleans toner particles resided on a surface of the photoconductive drum after the transferring processing is completed.

The transferring portion 9 is provided with a transferring roller 91. In a state where the transferring roller 91 is pressed onto the photoconductive drum 3, a toner image formed on the photoconductive drum 3 is transferred to a recording sheet conveyed from a conveyance passage 83.

The sheet feeding section 8 is provided with a sheet feeding cassette 81, a pickup roller 82, the conveyance passage 83, the conveyance roller 84 and the like, and feeds recording sheets stacked on the sheet feeding cassette 81 to the side of the image forming section 2 and the transferring section 9 (downstream side).

The fixing section 11 is provided on downstream from the image forming section 2 and the transferring section 9, and has a heating roller 11*a* and a pressing roller 11*b*. The fixing section 11 performs a fixing processing to a toner image transferred to a recording sheet.

On further downstream side from the fixing section 11, there are provided a conveying roller 86, a discharging roller 87, a conveyance passage 85 and the like. A recording sheet to which a fixing process is performed in the fixing section 11 is conveyed by these rollers on the conveyance passage 85 to further downstream and discharged to the sheet discharging tray 12 provided in an upper portion of the printer 1.

Figure 2:
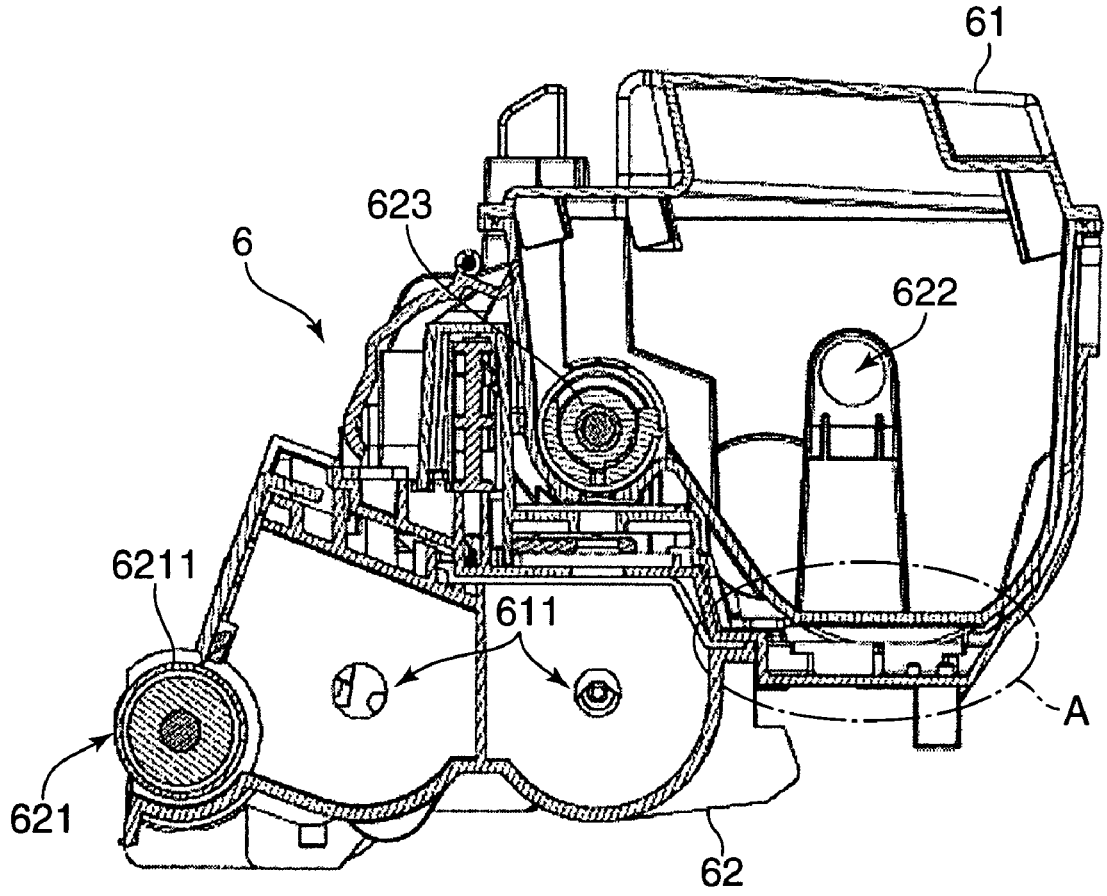
FIG. 2 is a sectional view showing a detailed configuration of a developing section.

FIG. 2 is a sectional view showing a detailed configuration of the developing portion 6. The developing portion 6 includes a toner cartridge 61 and a developing unit 62. The toner cartridge 61 is constructed by a container for storing toner (developer). The developing unit 62 has a developing roller 621 and the like. The developing portion 6 supplies toner particles in the toner cartridge 61 to a stirring portion by rotational driving of a drawing roller 622 and a supplying roller 623, and then supplies the toner particles to a stirring portion developing roller 621 by rotational driving of a stirring roller 611 (stirring screw). Along a peripheral surface of the developing roller 621, there is provided a developing sleeve 6211. The developing sleeve 6211 is applied with a developing bias so that toner particles positively charged in the stirring portion are attached to disposed portion (portion of an electrostatic latent image formed by removing static electricity by disposing) on a surface of the photoconductive drum 3 (FIG. 3).

The developing portion 6 is so constructed that the toner cartridge 61 is detachably mounted to the developing unit 62.

Figure 3:
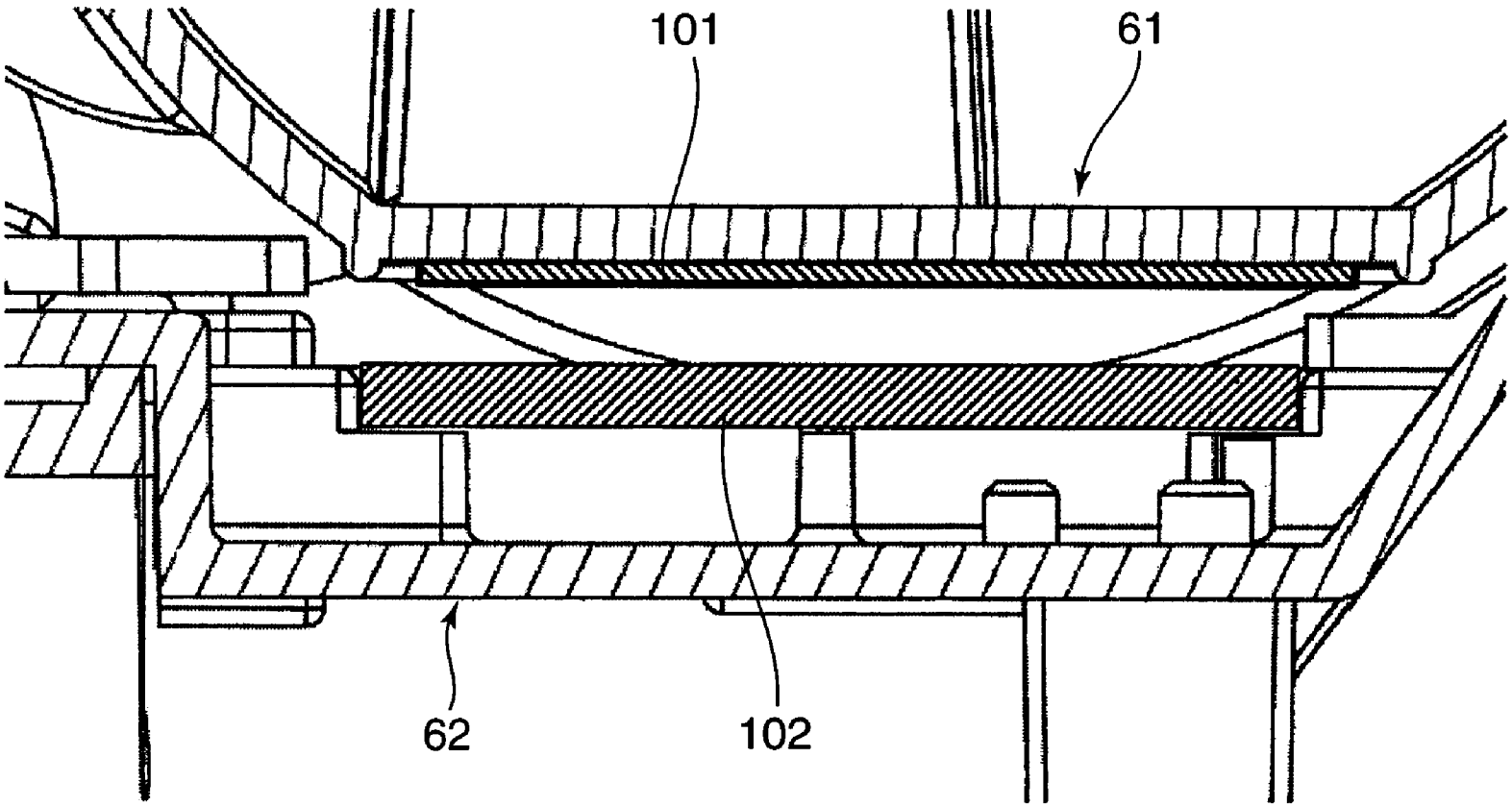
FIG. 3 is a partially enlarged view showing an area of the developing section indicated by a reference numeral A in FIG. 2.

FIG. 3 is a partially enlarged view showing an area of the developing portion 6 indicated by a reference numeral A in FIG. 2. A configuration of a lower portion of the mounted toner cartridge 61 is shown in details.

On one side wall portion of the toner cartridge 61, a wireless tag 101 is attached. On one side wall portion of the developing unit 62, a communication unit 102 is attached. When the toner cartridge 61 is mounted, the wireless tag 101 and the communication unit 102 face each other while being spaced apart a predetermined distance (e.g. about 5 mm).

The wireless tag 101 performs a communication (a wireless communication) with the communication unit 102. The wireless tag 101 is provided with a semiconductor chip (wireless IC chip) capable of sending and receiving data by using electromagnetic waves and generates an electromotive force by electromagnetic waves from the communication unit 102 (on the basis of the principles of electromagnetic induction). Accordingly, the wireless tag 101 drives a circuit with this electric power and exchanges control data (identification code) or the like with the communication unit 102.

The communication unit 102 performs a wireless communication with the wireless tag 101 by outputting an electromagnetic wave having a predetermined frequency at a predetermined communication output.

As described in details hereinafter, the communication unit 102 is so constructed that it can modulate the communication frequency. Further, as a result of modulating the frequency, the communication unit 102 changes a communication output.

Figure 4:
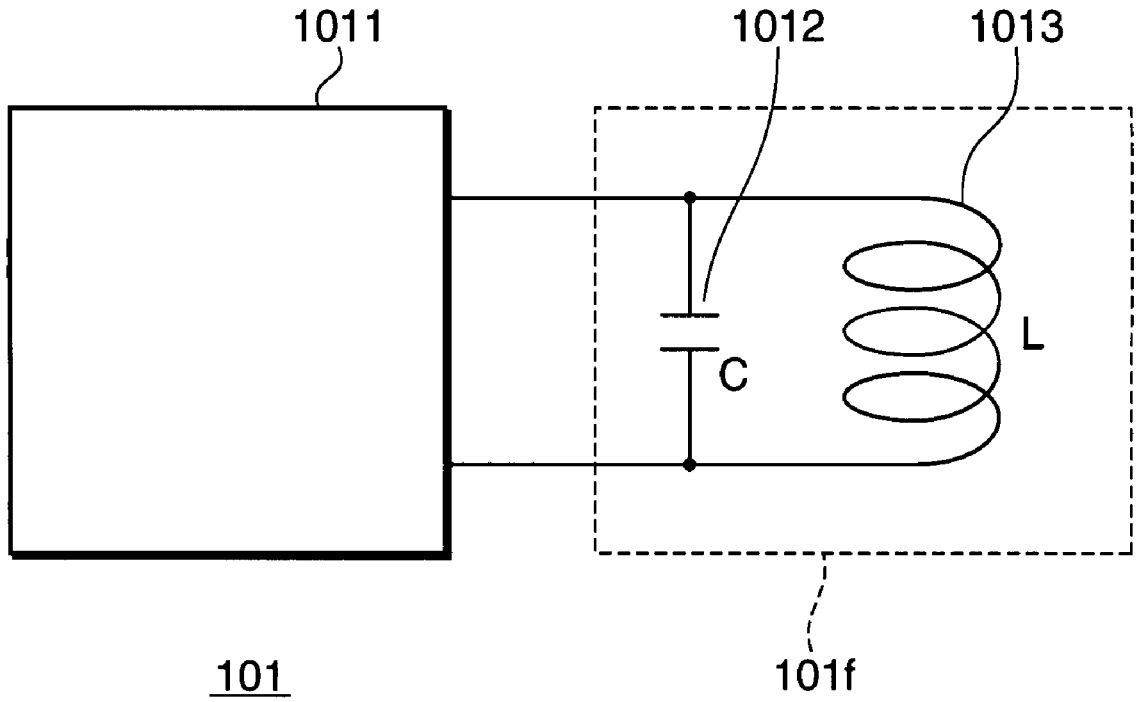
FIG. 4 is a diagram showing a schematic configuration of a wireless tag.

FIG. 4 is a diagram showing a schematic construction of the wireless tag 101. The wireless tag 101 is constructed by an LC resonant circuit for example and includes a memory 1011, a resonant condenser 1012 and a resonant inductance (antenna) 1013.

The memory 1011 is a memory which stores peculiar information of the cartridge. More specifically, the memory 1011 stores the number of using the toner cartridge, characteristics of toner particles in the container, amount of remaining toner particles and the like. The communication unit 102 reads out the information stored in the memory 1011 by performing a communication with the wireless tag 101.

The resonant inductance (antenna) 1013 is an antenna constructed as a loop antenna. The wireless communication with the communication unit 102 is performed via the antennal 1013.

The resonant inductance (antenna) 1013 and the resonant condenser 1012 constitutes a resonant circuit 101*f*. The resonant circuit 101*f* works as a filter which makes input and output signals from the resonant inductance (antenna) 1013 become only signals having a resonant frequency of the resonant circuit 101*f* or a frequency in proximity to a predetermined value which is close to the resonant frequency.

Figure 5:
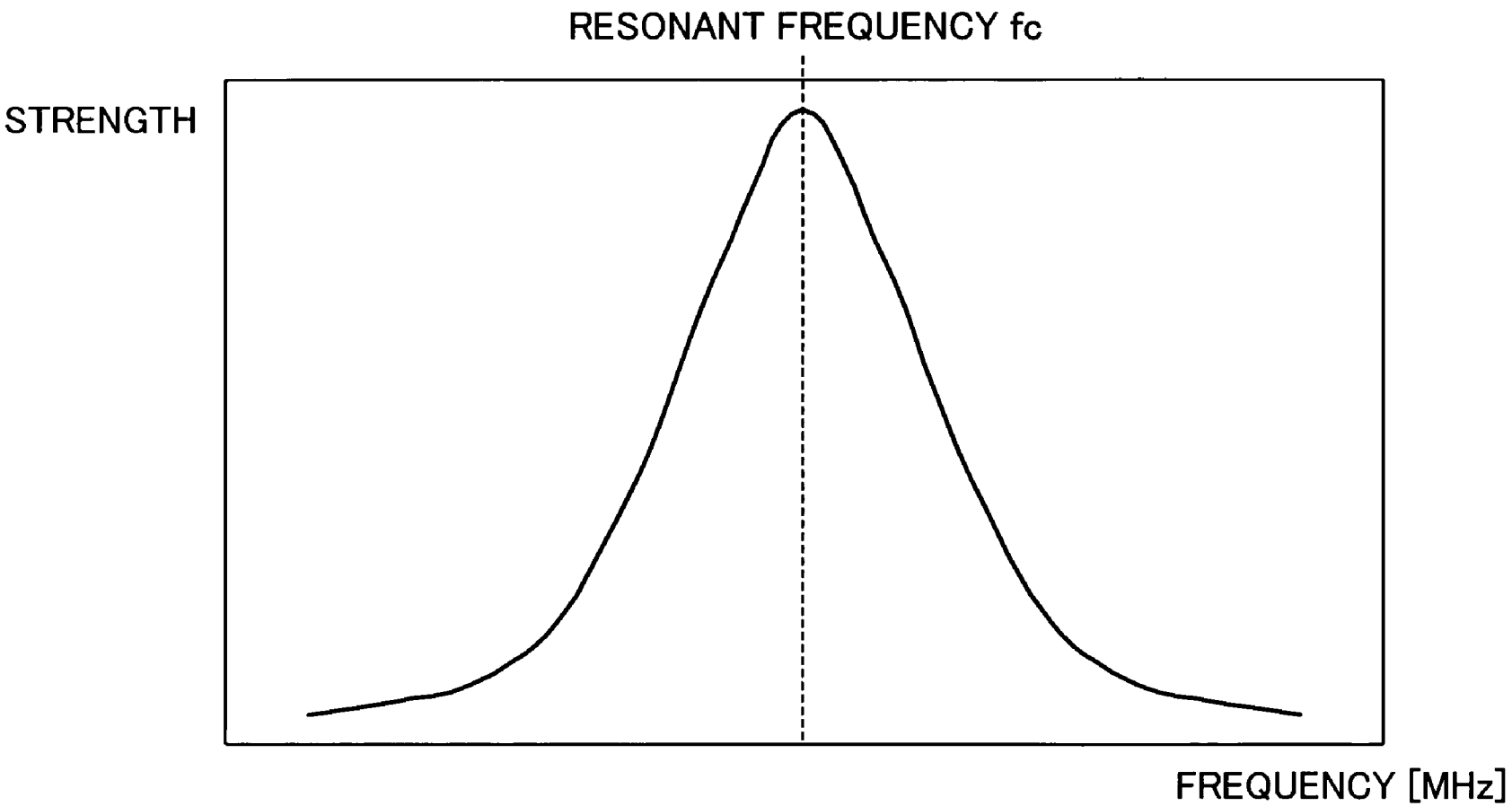
FIG. 5 is a diagram showing a relationship between frequencies and strength of signals in a resonant circuit.

FIG. 5 is a diagram showing a relationship between a frequency and strength of a signal in the resonant circuit 101*f*.

As shown in this figure, a strength of a signal which passes through the resonant circuit 101*f* becomes weaker as a signal frequency departs from the resonant frequency fc.

With respect to an inductance L of the resonant inductance (antenna) 1013 and a quantity C of the resonant condenser 1012, the resonant frequency fc is determined by an equation of "$fc=1/(2\pi*(L*C)^{1/2})$." In the present embodiment, the electromagnetic wave outputted from the communication unit 102 has a basic frequency of 13.56 MHz, and the inductance L of the resonant inductance which the resonant circuit 101*f* has and the quantity C of the resonant condenser 1012 are set so that the resonant frequency fc becomes the basic frequency of 13.56 MHz.

Herein, when toner particles (magnetic bodies) are supplied to the toner cartridge 61, the resonant frequency fc is affected and modulated. In a case where the resonant frequency is modulated and an operation electric power necessary for operating the wireless tag 101 cannot be obtained, the wireless tag 101 cannot perform an appropriate operation in the wireless communication with the communication unit 102. Therefore, the printer 1 performs the processing to solve the problem. As described in details hereinafter, the printer 1 suppresses a negative effect (unwanted irradiation) which has been occurred in conventional printers by modulations of the resonant frequency as a factor.

Figure 6:
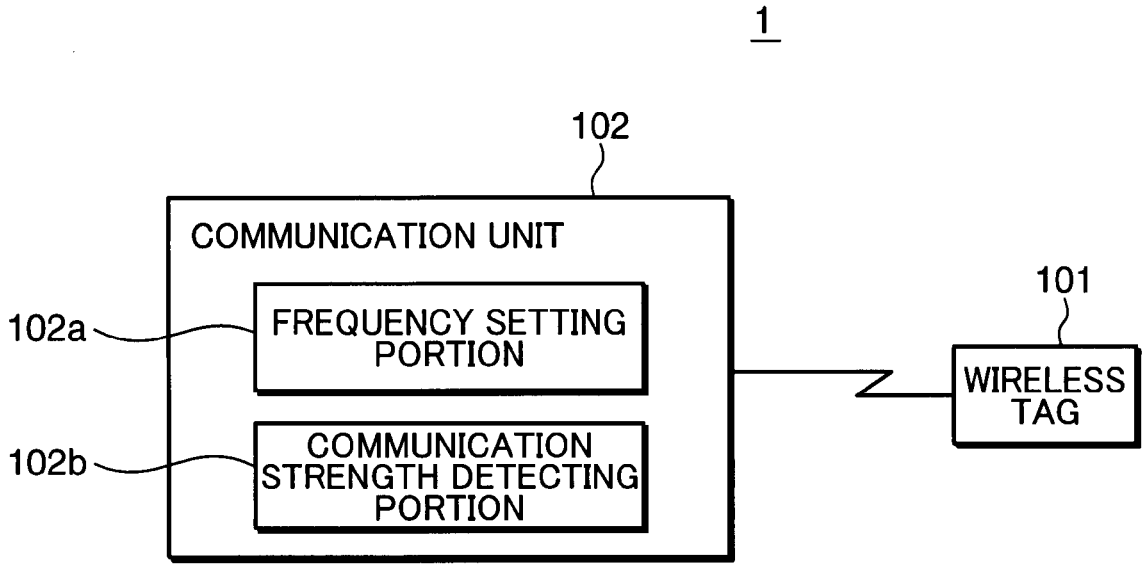
FIG. 6 is a diagram showing a schematic configuration of a communication unit.

FIG. 6 is a diagram showing a schematic configuration of the communication unit 102. The communication unit 102 includes a frequency setting portion 102*a* and a communication strength detecting portion 102*b*.

The communication strength detecting portion 102*b* detects a strength of the wireless communication between the communication unit 102 and the wireless tag 101. The communication strength detecting portion 102*b* performs outputting to the side of the wireless tag 101 at a predetermined communication output level (communication strength). At this time, the wireless tag 101 transmits to the communication unit 102 control data (identification data) or the like by using an electric power generated by the wireless tag 101 on the basis of the output from the communication unit 102. The communication strength detecting portion 102*b* detects greatness of output of response of the wireless tag 101 to the communication unit 102 in this case, and detects the strength of the wireless communication. To detect the communication strength, the communication strength detecting portion 102*b* includes a voltage detecting circuit for detecting a signal level of a signal received from the wireless tag 101.

On the other hand, the frequency setting portion 102*a* determines a communication frequency used for the wireless communication performed by the communication unit 102 and the wireless tag 101. The frequency setting portion 102*a*, on the basis of communication strength for each frequency detected by the communication strength detecting portion 102*b*, for example, determines a frequency which exerts the greatest communication strength. More specifically, the frequency setting portion 102*a* determines a frequency which makes the communication distance the longest as a communication frequency among frequencies used in the detection, and sets the determined communication frequency as a communication frequency of the communication unit 102 used for communicating with the wireless tag 101. In a case of communicating with the wireless tag 101, after the communication frequency is determined by the frequency setting portion 102*a*, the communication unit 102 starts the communication with the wireless tag 101 at the determined frequency.

It should be noted that the frequency setting portion 102*a* may be the one which modulates the communication frequency by using a software by an information processing device, or may be the one which modulates the communication frequency by using a frequency modulating circuit such as a condenser.

Figure 7:
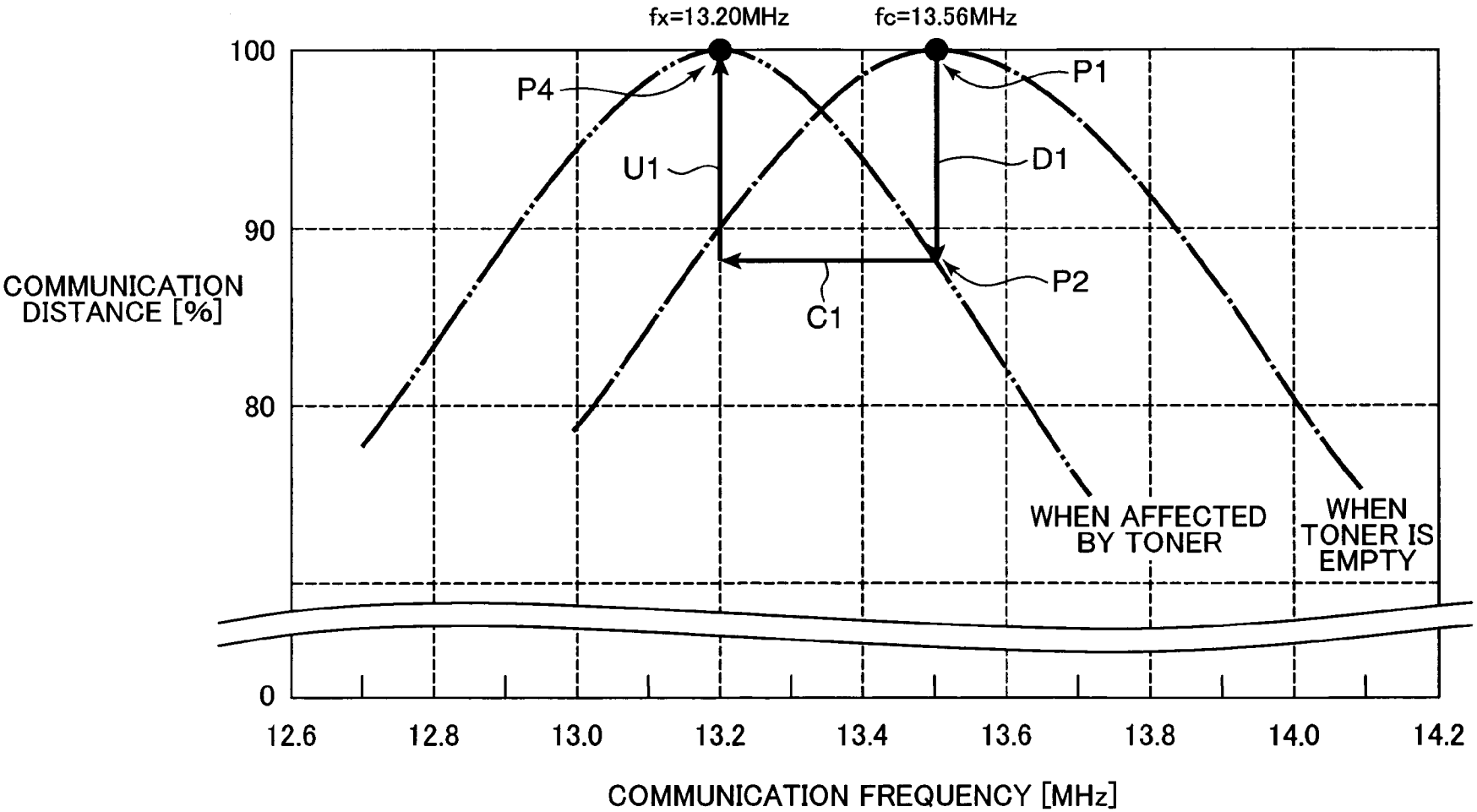
FIG. 7 is a diagram showing a communication frequency determining processing.

FIG. 7 is a diagram showing a communication frequency determining processing. In FIG. 7, a horizontal axis shows communication frequency of an output signal from the communication unit 102, and a vertical axis shows a communication distance between the communication unit 102 and the wireless tag 101. Resonance is utilized in the wireless communication between the communication unit 102 and the wireless tag 101. Accordingly, when the communication frequency is modulated, the communication distance changes. At this time, the change of the communication distance has a positive correlation with respect to the change of a signal strength shown by vertical axis in FIG. 5.

A one-dotted chain line in FIG. 7 shows a relationship between the communication frequency and the communication distance when the toner cartridge is empty. When the communication frequency is equal to the basic frequency (resonant frequency fc of the resonant circuit 101*f*), more specifically when the toner cartridge 61 is empty and the frequency is 13.56 MHz in the present embodiment, the frequency becomes resonant. As a frequency departs from the basic frequency 13.56 MHz, the communication distance of the wireless communication between the communication unit 102 and the wireless tag 101 becomes shorter.

Specifically, assuming that the communication distance is 100% at the time when the frequency is 13.56 MHz, if the communication frequency becomes smaller than the basic frequency i.e. if the frequency becomes 13.00 MHz, the communication distance becomes about 80%. Further, on the contrary, if the frequency gets larger and becomes 14.1 MHz, the communication distance becomes 75%.

On the other hand, a two-dotted chain line shows a relationship at the time of being affected by toner particles. Assuming that the resonant frequency at the time when the toner cartridge 61 is empty is the basic frequency of 13.56 MHz, when affected by toner particles, the resonant frequency is lowered by about 300 kHz by an influence of magnetic bodies included in toner particles, and the communication distance becomes maximum at frequency of fx=13.20 MHz.

As a result, if the communication is performed at the basic frequency of 13.56 MHz, the communication distance indicated by the reference numeral P1 is realized under normal condition. However, under a condition of being affected by toner particles, the communication can be performed only in the communication distance indicated by the reference numeral P2. More specifically, if the communication is performed at the frequency of 13.56 MHz which is the resonant frequency at the time when toner cartridge 61 is empty, the communication distance becomes short as indicated by an arrow D1 under a condition of being affected by toner particles. If the communication distance becomes short as described above, the communication between the communication unit 102 and the wireless tag 101 becomes unstable. Accordingly, the prior art technology set communication output at the time when the toner is empty to be an excessive communication output with amount of reduction of distance indicated by the arrow D1 to accomplish the communication distance indicated by the reference numeral P1 under normal condition not affected by toner particles. However, if the communication output is set excessively as described above, it causes a problem that the communication between the communication unit 102 and the wireless tag 101 accompanies great unwanted irradiation when the toner is empty. For example, the communication distance shown by the reference numeral P1 at the time when toner is empty becomes 120% of the distance indicated in this figure by an excessive power corresponding to a reduced amount of distance indicated by the arrow D1. Accordingly, a great irradiation occurs.

To solve this problem, a control described herebelow is performed in the present embodiment based on that longness and shortness of the communication distance appears as strongness and weakness of the communication strength between the communication unit 102 and the wireless tag 101. At first, the communication strength detecting portion 102*b* detects the communication strength between the communication unit 102 and the wireless tag 101. That the communication distance between the communication unit 102 and the wireless tag 101 became short like the communication distance indicated by the reference numeral P2 appears as lowering of communication strength detected by the communication strength detecting portion 102*b*. In a case where the communication strength indicating lowering of the communication distance is detected, the frequency setting portion 102*a* sets, as indicated by an arrow C1, the communication frequency of the communication unit 102 to a relatively low communication frequency (for example, frequency fx=13.20 MHz). By lowering the communication frequency as described above, the communication output as indicated by the reference numeral P4 which is the same as the reference numeral P1 can be obtained as indicated by an arrow U1, even in the case of the communication distance characteristic of the condition of being affected by toner particles as indicated by two-dotted chain line.

Further, in the following descriptions, in the maximum value of the communication distance like the communication distance of the reference numeral P4, the wireless communication between the communication unit 102 and the wireless tag 101 is possible. In other words, even in the case of being affected by toner particles, the communication is possible at the communication distance of the maximum value.

Figure 8:
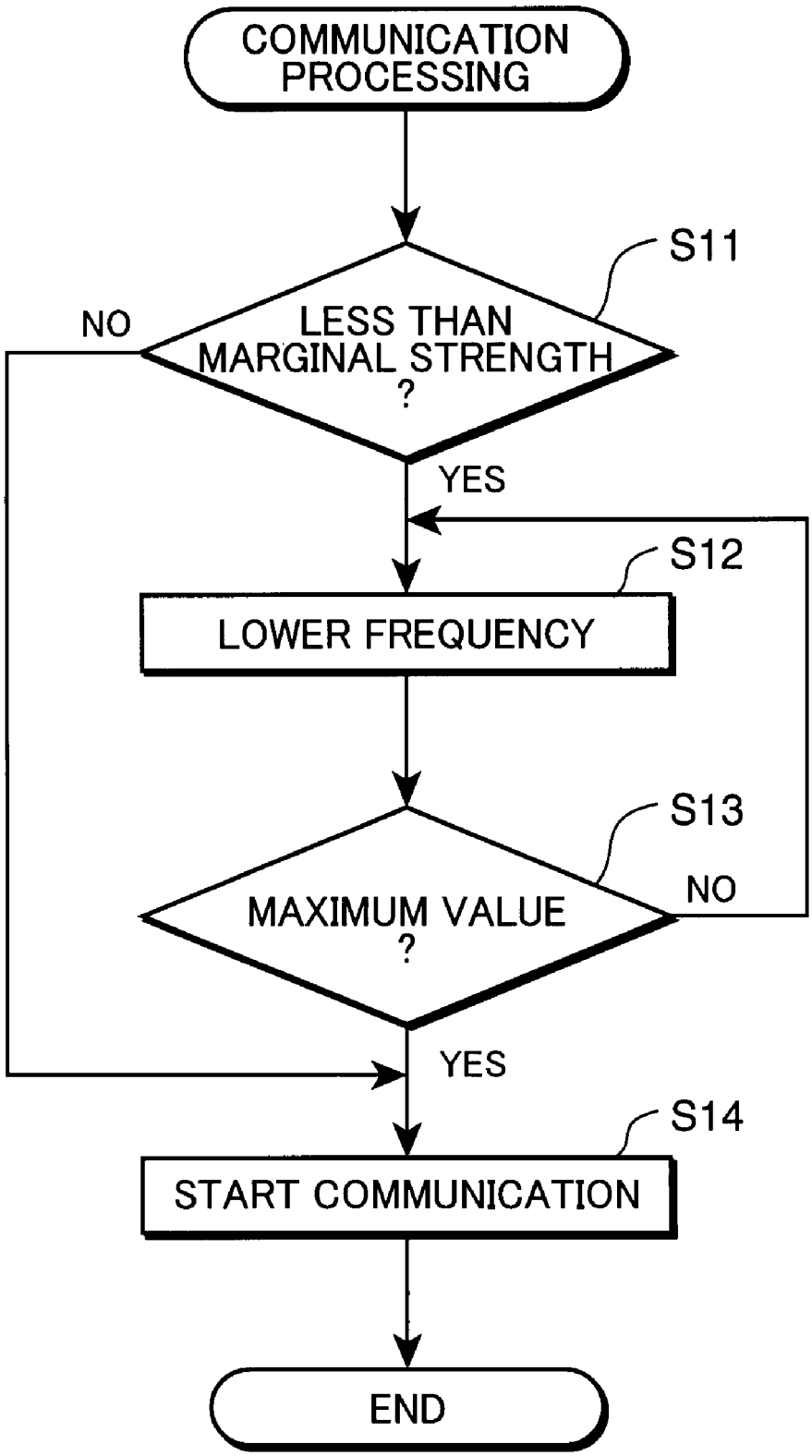
FIG. 8 is a flowchart showing a processing in which the communication unit determines communication frequency and performs communication.

FIG. 8 is a flowchart showing a processing in which the communication unit 102 determines communication frequency and performs communication. In the case of communicating with the wireless tag 101, the communication unit 102 performs a communication processing for determining the communication frequency at each time of communication. After performing the communication processing of determining the communication frequency, the communication unit 102 starts communications with the wireless tag 101 in the determined frequency. In the communication processing of determining the communication frequency, the frequency at which the optimum communication is possible when the toner cartridge 61 is empty is set as the basic frequency (13.56 MHz in the above embodiment).

In a step S11, the communication strength detecting portion 102*b* determines whether or not the communication strength between the communication unit 102 and the wireless tag 101 is lowered. When the communication strength is not at the level where an appropriate wireless communication cannot be performed (hereinafter, referred to as marginal strength) and the communication is possible (Step S11:NO), the frequency setting portion 102*a* does not change the communication frequency from the basic frequency. The communication unit 102 starts the communication processing (Step S14).

On the other hand, when the communication strength detected by the communication strength detecting portion 102*b* is lower than the marginal strength (Step S11:YES), the frequency setting portion 102*a* and the communication strength detecting portion 102*b* perform the processing of Steps S12 to S13 and change the communication frequency.

In Step S12, the frequency setting portion 102*a* makes the communication frequency of the communication unit 102 a predetermined amount smaller. The communication strength detecting portion 102*b* detects a communication strength between the communication unit 102 and the wireless tag 101. The frequency setting portion 102*a* determines whether or not the communication strength detected by the communication strength detecting portion 102*b* is the predetermined communication strength showing the maximum communication distance. In other words, in Step S13, the frequency setting portion 102*a* determines whether or not the maximum value of the communication distance (maximum value) as indicated by the reference numeral P4 in FIG. 7 is achieved by the frequency made smaller the predetermined amount.

In a case where the maximum value of the communication distance (maximum value) is achieved (Step S13:YES), the frequency setting portion 102*a* sets the communication frequency of the communication unit 102 at the frequency which is made smaller. Then, the communication unit 102 starts the communication processing at the set communication frequency (Step S14).

On the other hand, when the maximum value of the communication distance (maximum value) is not achieved (Step S13:NO), the frequency setting portion 102*a* further lowers the frequency the predetermined specified amount (Step S12) and performs the processing of Step S13 again. Namely, on the basis of the communication strength for each frequency detected by the communication strength detecting portion 102*b*, the frequency setting portion 102*a* determines the frequency to realize the longest communication length among the frequencies used in the detection as the communication frequency.

Accordingly, even when conditions of a peripheral environment of the developing portion 6 (communication unit 102 and wireless tag 101) are changed by factors such as reducing of toner particles in the toner cartridge 61 from a filled state, the communication between the communication unit 102 and the wireless tag 101 is performed at the communication frequency to realize the maximum communication length under the changed condition. Accordingly, there is no need to make the communication output of the communication unit 102 excessively great so that unwanted irradiation occurred at the time of communication between the communication unit 102 and the wireless tag 101 can be reduced further than the conventional manner.

Next, other embodiments of the present invention are described.

(A) In the above-described embodiment, when affected by toner particles, the communication distance at each frequency is realized at relatively low frequency as shown in FIG. 7. In other words, the graph slides toward the side of lower frequency. However, the present invention is not limited to the embodiment above. For example, depending on kind of toner particles, the graph may slide toward the higher frequency when affected by toner particles. The present invention can be applied even in such a case. In this case, the frequency setting portion 102*a* does not decrease but increases the frequency in Step S12 of FIG. 8. Further, there is a case where it cannot be determined which of lower and higher direction the graph slides. In such a case, the frequency setting portion 102*a* may change the frequency to a lower frequency for specified times, and thereafter change the frequency for a specified times reversely from the basic frequency to a higher frequency in Step S12.

(B) It was described above that the frequency setting portion 102*a*, like the time indicated by the reference numeral P4 on the two-dotted chain line in FIG. 7, sets the communication frequency to the frequency realizing the maximum communication distance (refer to Steps S12 to S13 in FIG. 8). However, it is not limited to the case. In Step S13, it may be so constructed as to simply detect whether or not the strength is appropriate to enable the wireless communication, namely, whether or not the communication strength of the wireless communication becomes larger than the marginal strength, and set the frequency as the communication frequency of the communication unit in a case where the communication strength of the wireless communication is greater than the marginal strength. In such arrangement, the communication is performed with the communication strength weaker than the case where the communication frequency is set to the frequency realizing the maximum communication distance. Accordingly, the unwanted irradiation can be further suppressed.

(C) Further, in the descriptions above, the communication strength detecting portion 102*b* performs outputting to the wireless tag 101 at a predetermined level. On the basis of greatness of a response signal from the wireless tag 101 responding to this, the strength of the wireless communication is detected. However, the present invention is not limited to this. For example, the communication strength detecting portion 102*b* may detect the level of an electromagnetic wave constantly transmitted from the wireless tag 101 regardless of an output from the communication unit 102, or may detect a signal outputted from the wireless tag 101 by using an electric power obtained from other than the communication unit 102 to specify the communication strength.

(D) Further in the description above, the communication strength detecting portion 102*b* for detecting a communication strength is provided so that a communication frequency is determined. However, the present invention is not limited to the case. For example, a detecting portion for directly detecting the unwanted irradiation may be provided. Accordingly, a frequency of the frequency setting portion 102*a* can be modulated like the one described above so as to suppress the communication strength when the unwanted irradiation is greater than a predetermined level.

(E) In the above-described embodiment, the case where the communication output is changed as a result of changing the communication frequency is shown. However, the present invention is not limited to the case. For example, the communication unit 102 may directly change the communication output a necessary amount under some conditions while a frequency is constant.

Figure 9:
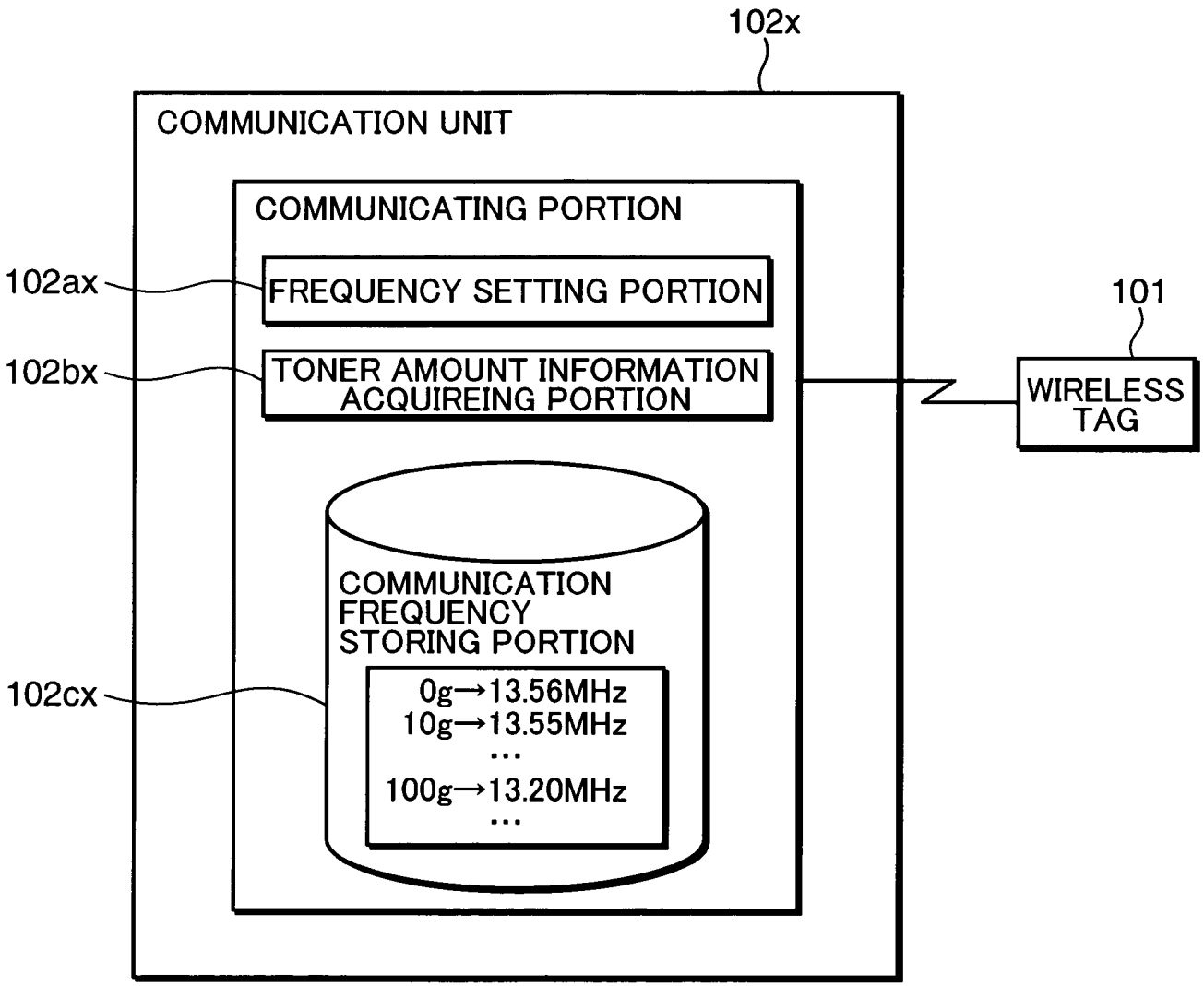
FIG. 9 is a diagram showing the communication unit which acquires toner amount information from the wireless tag.

Another embodiment of the image forming apparatus according to the present invention is described. In another embodiment, the communication frequency of the communication unit 102 is determined on the basis of toner amount information which identifies an amount of toner particles existing in the toner cartridge 61. FIG. 9 is a diagram showing the communication unit 102*x* which acquires toner amount information from the wireless tag 101. Descriptions regarding a construction and processing which are same as the above-described embodiment is abbreviated.

The communication unit 102*x* does not have a component which corresponds to the communication strength detecting portion 102*b* shown in FIG. 6. On the other hand, there is provided a toner amount information acquiring portion 102*bx*. The toner amount acquiring portion 102*bx* obtains from the wireless tag 101 toner amount information showing a resided amount of toner particles existing in the toner cartridge 61.

The frequency setting portion 102*ax* determines a communication frequency on the basis of toner amount information obtained by the toner amount information acquiring portion 102*bx*.

A communication frequency storing portion 102*cx* associates toner amount and a predetermined communication frequency which realizes the longest communication distance at that amount of toner, and stores the same. The communication frequency setting portion 102*ax* reads out from the communication frequency storing portion 102*cx* a frequency which corresponds to the toner amount shown by the obtained toner amount information. Then, the communication frequency setting portion 102*ax* determines as a communication frequency of the communication unit 102, and then sets the communication frequency to the communication unit 102.

Figure 10:
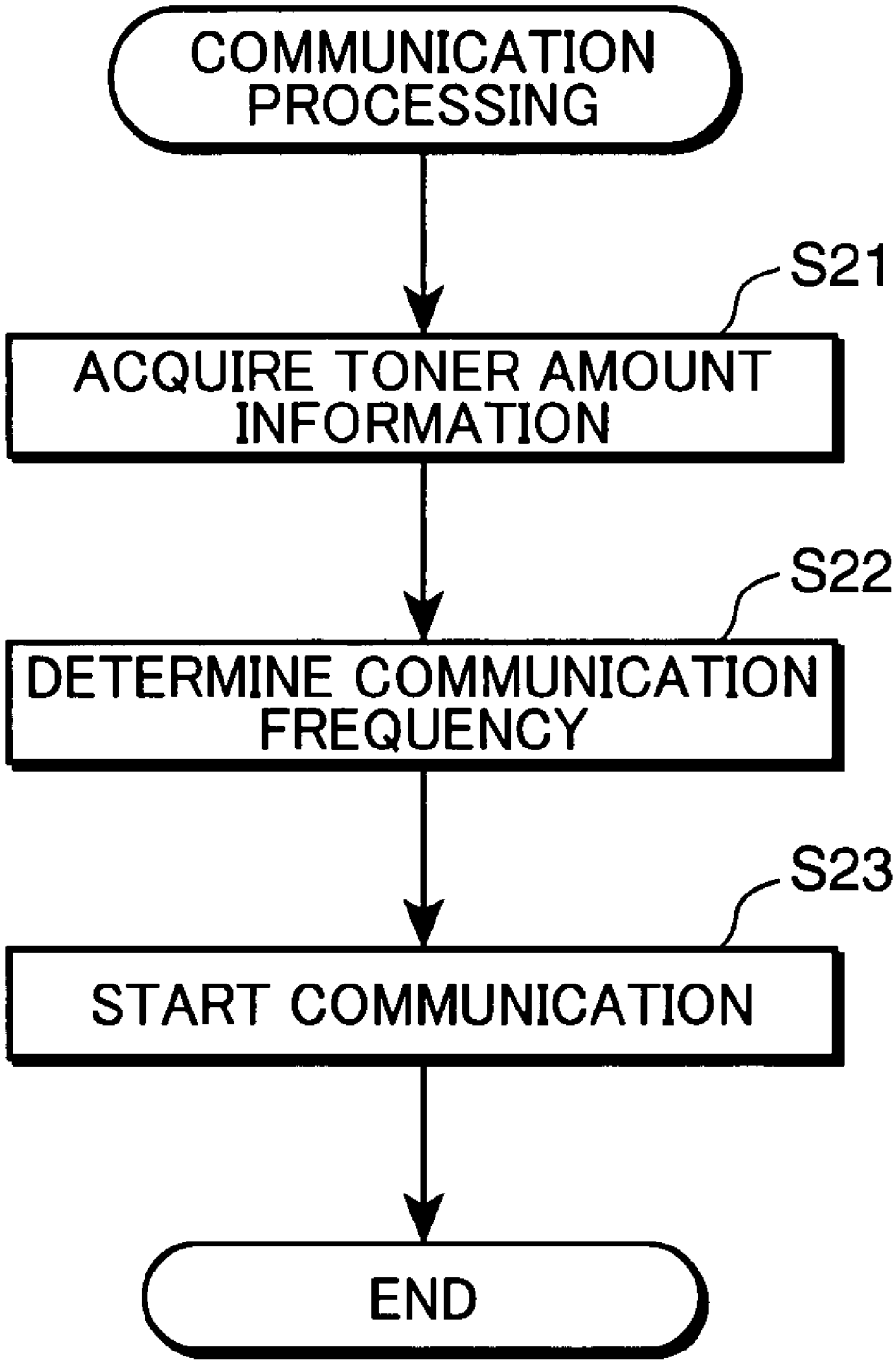
FIG. 10 is a flowchart showing a processing performed by a communication unit according to another embodiment.

FIG. 10 is a flowchart showing a processing performed by the communication unit 102*x* according to another embodiment. The communication unit 102*x* performs a communication processing of determining the communication frequency for each time of the communication in a case of communicating with the wireless tag 101, and then starts a communication with the wireless tag 101 in the determined frequency after the communication processing of determining the communication frequency.

In Step S21, the toner amount information acquiring portion 102*bx* acquires toner amount information from the wireless tag 101. In Step S22, the frequency setting portion 102*ax* reads out from the communication frequency storing portion 102*cx* a frequency corresponding to the toner amount information acquired by the toner amount information acquiring portion 102*bx*, determines as the communication frequency of the communication unit 102, and sets the communication frequency to the communication unit 102 (S22). In Step S23, the communication unit 102 starts a communication in the set communication frequency.

According to this construction, when the toner cartridge 61 is mounted to the main body of the printer 1, the communication unit 102*x* performs the wireless communication with the wireless tag 101. In the communication unit 102*x*, toner amount information which identifies a residing toner amount is acquired by the toner amount information acquiring portion 102*x*. The frequency setting portion 102*ax* sets a communication frequency of the communication unit 102 to the communication frequency which realizes the longest communication distance under conditions of the acquired toner amount information.

Accordingly, even when the amount of toner particles in the toner cartridge 61 is reduced from a filled state, a communication between the communication unit 102 and the wireless tag 101 is performed in the communication frequency which realizes the maximum communication distance under the condition after the change. Accordingly, there is no need to make a communication output of the communication unit 102 excessively great so that the unwanted irradiation occurred at the time of communication between the communication unit 102 and the wireless tag 101 can be made lower than the conventional manner.

The present invention is an image forming apparatus comprising: a main body; a toner container detachably mounted to the main body; a wireless tag provided on the toner container; and a communicator provided in the main body and being capable of performing a wireless communication with the wireless tag, wherein the communicator includes: a communication strength detector for detecting a communication strength of the wireless communication performed with the wireless tag; and a communication output adjuster for changing the communication output of the communicator so that the communication strength detector detects a predetermined communication strength, when a communication strength detected by the communication strength detector is not the predetermined communication strength.

Further, the present invention is an image forming apparatus comprising: a main body; a communicator provided in the main body and being communicable with a wireless tag provided on a toner container detachably mounted to the main body, wherein the communicator includes: a communication strength detector for detecting a communication strength of the wireless communication performed with the wireless tag; and a communication output adjuster for changing the communication output of the communicator so that the communication strength detector detects a predetermined communication strength, when a communication strength detected by the communication strength detector is not the predetermined communication strength.

According to these inventions, when a communication strength detected by the communication strength detector is not the predetermined communication strength, the communication output of the communicator adjusted so that the communication strength detector detects a predetermined communication strength. Accordingly, even in a case where a communication distance between the communicator and the wireless tag is changed due to factors such as kinds and amount of toners contained in the toner container, the communication output of the communicator is adjusted so that the communication strength detector detects a predetermined communication strength. Therefore, the communication output of the communicator can be maintained in a state where a communication with the wireless tag can be performed regardless of changes of conditions even though a communication output level of the communicator is not set to be excessively great. Thus, the unwanted irradiation occurred at the time of communication of the communicator can be suppressed to a low level.

Further, in the present invention, the wireless tag obtains electric power from an output of the communicator and responds to the communicator; and the communication strength detector detects a communication strength of the wireless communication with the wireless tag based on a strength of a response from the wireless tag when the communicator communicates with the wireless tag at a predetermined communication output.

According to this, a communication strength can be detected with high accuracy.

Further, in the present invention, the communication output adjuster includes a frequency modulator for changing the communication output by modulating the communication frequency.

According to this, a highly efficient construction can be realized where the communication output is changed only by changing the communication frequency.

Further, in the present invention, the frequency modulator sets the communication frequency at a value to realize a communication strength which enables at least the wireless communication to be performed.

According to this, a communication takes place at a communication strength lower than the case of setting a communication strength at a frequency to realize the maximum communication distance. Accordingly, the unwanted irradiation can be further suppressed.

Further, in the present invention, the communication strength detector respectively detects communication strengths at a plurality of frequencies set by the frequency modulator; and the frequency modulator sets as the communication frequency the one of the plurality of frequencies that causes the greatest communication strength to be detected by the communication strength detector.

According to this, the communication output of the communicator can be accurately set to a communication frequency to realize the maximum communication strength of the communicator.

Further, the present invention is an image forming apparatus comprising: a main body; a toner container detachably mounted to the main body; a wireless tag provided on the toner container; a communicator provided in the main body and being capable of performing a wireless communication with the wireless tag, wherein the communicator includes: a toner amount information acquirer for acquiring toner amount information showing an amount of toner particles contained in the toner container; a storage section for storing a relationship between the toner amount information and the communication output of the communicator; and a communication output adjuster for reading out a communication output corresponding to a toner amount information acquired by the toner amount information acquirer and setting as the communication output of the communicator the communication output of the communicator.

Further, the present invention is an image forming apparatus comprising: a main body; a communicator provided in the main body and being communicable with a wireless tag provided on a toner container detachably mounted to the main body, wherein the communicator includes: a toner amount information acquirer for acquiring toner amount information showing an amount of toner particles contained in the toner container; a storage section for storing a relationship between the toner amount information and the communication output of the communicator; and a communication output adjuster for reading out a communication output corresponding to a toner amount information acquired by the toner amount information acquirer and setting as the communication output of the communicator the communication output of the communicator.

According to these, by the wireless communication between the communicator and the wireless tag, the toner amount information acquirer acquires toner amount information showing an amount of toner contained in the toner container. The communication output adjuster reads out from the storage section a communication output corresponding to the acquired toner amount information and sets the communication output of the communicator. Accordingly, a negative effect of great unwanted irradiation occurred due to an excessive communication output exerted even though there is a few toner can be suppressed.

Further, the present invention further includes a frequency modulator for changing the communication output by modulating a communication frequency.

According to this a highly effective construction can be realized where the communication output is changed just by modulating a communication frequency.

This application is based on Japanese Patent application serial No. 2006-031829 filed in Japan Patent Office on Feb. 9, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a main body; a toner container detachably mounted to the main body;

a wireless tag provided on the toner container;

a communicator provided in the main body and being capable of performing a wireless communication with the wireless tag, wherein the communicator includes:

a toner amount information acquirer for obtaining toner amount information showing an amount of toner particles contained in the toner container;

a storage section for storing a relationship between the toner amount information and a communication output of the communicator; and a communication output adjuster for reading out a communication output corresponding to a toner amount information acquired by the toner amount information acquirer and setting the read communication output as the communication output of the communicator.

2. The image forming apparatus according to claim 1, wherein the communication output adjuster includes a frequency modulator for changing the communication output by modulating a communication frequency.

3. An image forming apparatus comprising:

a main body; a communicator provided in the main body and being communicable with a wireless tag provided on a toner container detachably mounted to the main body, wherein the communicator includes:

a toner amount information acquirer for obtaining toner amount information showing an amount of toner particles contained in the toner container;

a storage section for storing a relationship between the toner amount information and a communication output of the communicator; and a communication output adjuster for reading out a communication output corresponding to a toner amount information acquired by the toner amount information acquirer and setting the read communication output as the communication output of the communicator.

4. The image forming apparatus according to claim 3, wherein the communication output adjuster includes a frequency modulator for changing the communication output by modulating a communication frequency.

* * * * *